US008758673B2

(12) United States Patent
Al-Mutairi

(10) Patent No.: US 8,758,673 B2
(45) Date of Patent: Jun. 24, 2014

(54) PORTABLE OVEN

(76) Inventor: Mohammed Marzouq Khalaf Al-Mutairi, Al-Fahaheel (KW)

( * ) Notice: Subject to any disclaimer, the term of this patent is extended or adjusted under 35 U.S.C. 154(b) by 302 days.

(21) Appl. No.: 13/208,095

(22) Filed: Aug. 11, 2011

(65) Prior Publication Data

US 2013/0038002 A1 Feb. 14, 2013

(51) Int. Cl.
*F27B 17/00* (2006.01)

(52) U.S. Cl.
USPC ..... 266/236; 266/200

(58) Field of Classification Search
USPC ..... 266/200, 144, 236
See application file for complete search history.

(56) References Cited

U.S. PATENT DOCUMENTS 4,150,707 A 4/1979 Emerick
4,337,929 A 7/1982 Evans
4,497,658 A 2/1985 Woog
4,628,895 A 12/1986 Santilli
4,822,412 A 4/1989 Badger et al.
5,315,922 A 5/1994 Keller
7,458,809 B2 12/2008 Hohenshelt et al.
2013/0038002 A1* 2/2013 Al-Mutairi ..... 266/144

* cited by examiner

*Primary Examiner* — Scott Kastler
(74) *Attorney, Agent, or Firm* — Lowe Hauptman & Ham LLP

(57) ABSTRACT

A portable thermal oven includes a metal frame and a plurality of terracotta panels disposed inside of the frame and defining an enclosed chamber having a front panel, a rear panel, two opposite side panels, a top panel and a bottom panel. The furnace also includes a terracotta door hingedly disposed in the front panel and including a handle on one side thereof for opening and closing the door. A plurality of gas manifolds and a plurality of gas burners are disposed on each of the two opposite sides of the chamber and a ventilation hatch is disposed in the top panel for exhausting fumes and excess heat. A first and a second gas cylinder and pipes for connecting the gas cylinders to the manifolds for supplying gas and/or air to the manifolds are also provided.

7 Claims, 2 Drawing Sheets

PORTABLE OVEN

FIELD OF THE INVENTION

This invention relates to a portable oven and more particularly to a portable thermal oven for melting gold or other precious metals.

BACKGROUND FOR THE INVENTION

Apparatus for making dental castings are well known and have been in use for many years. For example, a Emerick U.S. Pat. No. 4,150,707 discloses a method and apparatus for making dental castings. As disclosed, a method and apparatus for making dental castings wherein a crucible is supported on a platform having a central opening positioned beneath the crucible over a mold cavity of the investment, This in turn is supported on a platform having a central opening. The upper platform is lowered against the investment so that a single sealed vessel comprising the crucible and investment cavity is formed. Air is then administered to the crucible and investment cavity at a point beneath the crucible opening so that both the investment and crucible may be purged. An arc is formed in the crucible thereby melting the casting material, and air under pressure is admitted to the top of the crucible thereby causing the molten casting material to flow into the investment cavity.

An additional U.S. Pat. No. 4,497,658 of Woog discloses a compact precious metal furnace and recovery method. The Woog patent discloses a highly compact and efficient tilting crucible furnace and smelting method for use in the direct smelting of a precious metal containing material. A furnace body having a refactory lined cavity which has a top opening is pivotally mounted on a support frame to allow tipping thereof. A cover having a first opening to receive a gas burner and a second multi-purpose opening therein is rigidly attached to the body. A gas burner attached to the cover provides a downwardly directed oxidizing flame into the cavity to oxidize iron which is added to the cavity and other impurities in the precious metal containing material. A flux is provided to a thoroughly liquid mixture and after heating the molten mass is poured through the multi-purpose cover opening into a mold. As the mold cools, a doré button of precious metal settles to the bottom of the mold and slag containing impurities forms on the top.

A further Santilli U.S. Pat. No. 4,628,895 discloses a kiln and autonomous heat source portable integrated unit. As disclosed therein, the invention belongs to the technical field for equipment destined for hobby use and, in particular, relates to a portable kiln and heat source integrated unit. The disclosure envisages there being a combination of a portable kiln with a firemouth positioned at the bottom of the kiln; a support structure able to set the kiln in a removeable fit-lock way on a burner facing the firemouth and heat insulating means of protection designed to safeguard at least the elements placed adjacent to the firemouth.

Finally a more recent U.S. Patent of Hohenshelt et al., U.S. Pat. No. 7,458,809 discloses a portable kiln having a set of wheels, a handle and a platform base. The wheels and the handle are attached on a first side of the kiln so that the kiln can be tilted and rolled on the wheels using the handle. The platform base provides a spaced distance between the wheels and the floor when the kiln is sitting upright in an operational position. The kiln may also include a metal outer shell wrapped about an oven portion. The outer shell has a shell sidewall radially spaced from the oven portion sidewall which forms an annular air channel between the outer shell sidewall and the oven portion. The outer shell has a C-shaped cross-section and it has upper and lower vent openings for the air channel. A hinge assembly allows a lid of the kiln to rest in an open position.

Notwithstanding the above, it is presently believed that there is a need and a potential commercial market for an improved thermal oven in accordance with the present invention. There should be a need for such ovens because they are of simple design, rugged, portable and can be constructed at a reasonable cost. Such ovens are suitable for use by hobbyist or dentist to smelt relatively small amounts of gold or precious metals.

BRIEF SUMMARY OF THE INVENTION

In essence, the present invention contemplates a portable oven for melting gold and other precious metals. The oven includes a metal frame, means for supporting the frame above the level of the floor and a plurality of insulating terracotta plates disposed in said frame and defining an enclosed chamber having a front panel, a rear panel, two opposite side panels, a top panel and a bottom panel and a terracotta door having four sides hingedly disposed in said front panel and including a handle on one side thereof for opening and closing the door. In addition, a plurality of gas manifolds and a plurality of gas burners are disposed on each of said opposite sidewalls of the chamber and a ventilation hatch is provided in the top panel for exhausting excess heat and fumes from the furnace. Further, a gas cylinder containing a supply of flammable gas and a pipe connecting the gas cylinder to the manifolds is provided. Further, a supply of air or oxygen and means for feeding the air or oxygen to the manifolds is included. The furnace also includes control means for regulating the flow of gas as well as the amount of air and/or oxygen from the gas cylinder as well as the supply of air or oxygen to the manifolds in order to regulate the heat in the furnace. In addition, a support member for receiving a mass of gold or precious metal for melting is disposed in a lower portion of the chamber and includes a plurality of passageways extending therethrough. A cone shaped terracotta lined receptacle is disposed in the bottom of the chamber and extends through the bottom panel with a larger portion thereof adapted to receive molten metal therein and a lower portion of the cone shaped receptacle adapted to direct molten metal into a mold or the like.

The invention will now be described in connection with the following figures wherein like reference numerals have been used to indicate like parts.

DESCRIPTION OF THE PREFERRED EMBODIMENTS OF THE INVENTION

Figure 1:
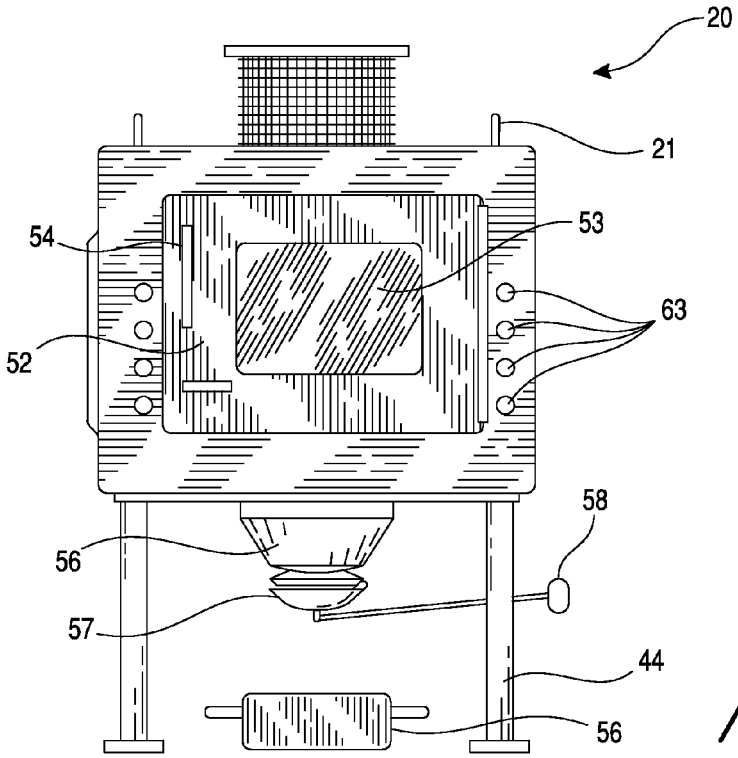
FIG. 1 is a front elevational view of a furnace in accordance with a first embodiment of the invention.
Figure 2:
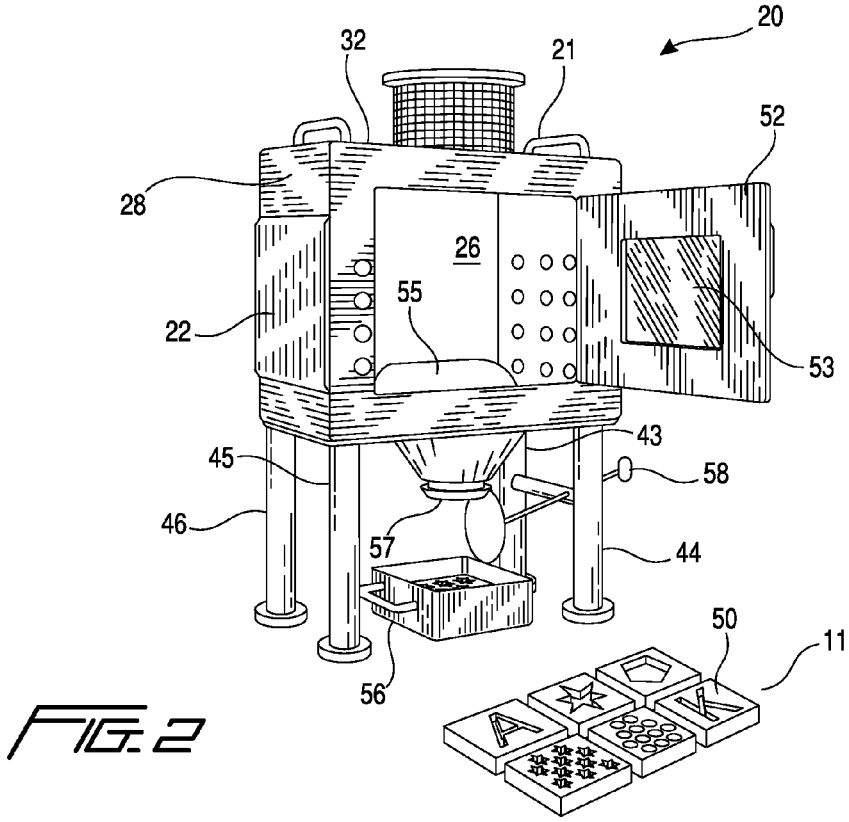
FIG. 2 is a front elevational view of the oven shown in FIG. 1, but with a door in the front of the furnace open to illustrate the interior thereof.

An oven in accordance with the present invention incorporates a metal frame such as a steel frame and a ceramic as for example a terracotta lining. Terracotta is clay based typically unglazed ceramic, but can also be applied to glazed ceramics. As used in the present invention a refined clay is formed and dried into appropriate shapes to form front, rear, and side plates as well as top and bottom plates to fit within a metal frame and accommodate manifolds and burners for heating with a gas flame. The plates after through drying are placed in a kiln or on top of a combustible material and finished in a conventional manner. The formed material is relatively weak but provides good insulation and with proper design is well supported by the steel frame.

An oven 20 in accordance with a preferred embodiment of the invention includes a metal frame 22 that defines a box like structure that is made up of 1"×1" angle iron and two handles 21 are attached to an upper portion of the oven 20 for moving the oven is welded together into a box like assembly that supports a front and rear panels 24 and 26 as well as two opposite side panels 28 and 30. Each side panel 28 and 30 is adjacent to the front and rear panels 24 and 26. The furnace 20 also includes a top panel 32 and bottom panel 34.

The bottom panel 34 may be supported by a base plate 35 that partially or fully supports the bottom panel 34. A metal or perhaps carbon support (not shown) may also be used to support the top panel 32. Further, each of the opposite side panels are designed to accommodate four vertically stacked manifolds 36, 37, 38 and 39 as well as three burners 40, 41 and 42 in each of the manifolds 36, 37, 38 and 39.

As shown, the metal frame 22 of furnace 20 is supported above the floor by four legs 43, 44, 45 and 46 with one of the legs at each corner of the base of the furnace. The legs 43, 44, 45 and 46 each have a height which is at least equal to the height of the furnaces inner-chamber to provide room below the furnace to insert a casting plate 50 or mold.

The furnace 20 also includes a door 52 having a glass plate 53 for looking inside of the oven 20. The door is hingedly fastened to the front panel 24 and includes a handle 54 for opening and closing the door to add gold or other metal to the inside of the furnace 20 and onto a support structure 55. The support structure 55 or plate also includes a plurality of passages extending therethrough for allowing molten metal to pass through the structure 55.

A cone shaped receptacle 56 is disposed in the bottom panel 34 with the larger diameter adjacent to the panel 34 and the smaller diameter at a lower portion thereof. The receptacle 56 also includes a tiltable closure portion 57 that is hingedly connected to an upper portion and connected by a passage to allow molten metal to flow into a casting plate 50 or mold by opening with the handle 58.

Figure 3:
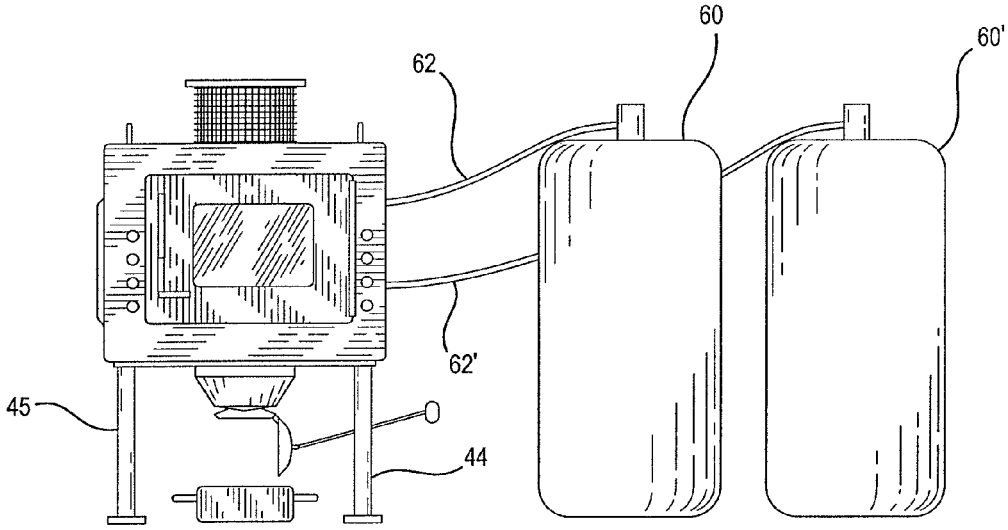
FIG. 3 is a front elevational view of the furnace shown in FIGS. 1 and 2 but with the furnace connected to a gas cylinder.
Figure 4:
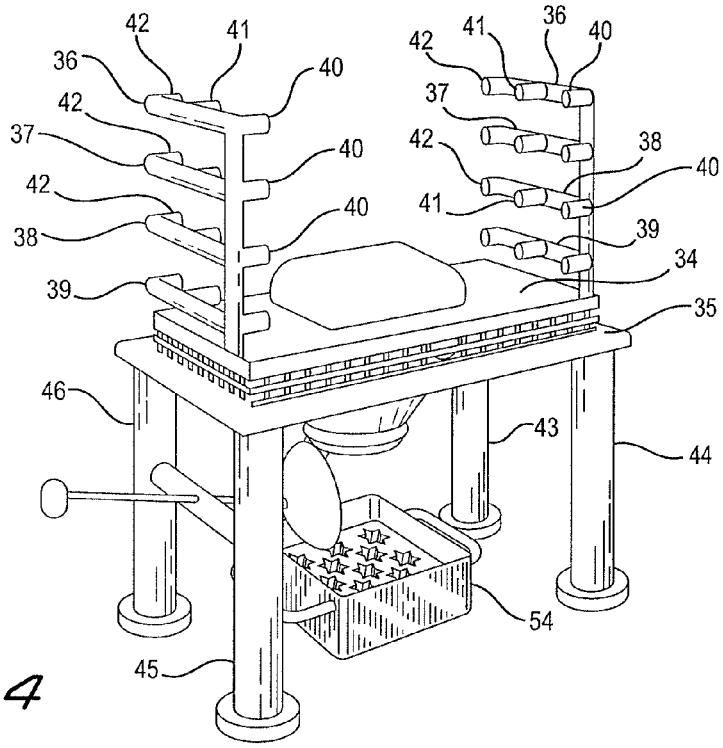
FIG. 4 is a perspective view illustrating a plurality of vertically stacked manifolds and including burners with a casting plate or mold below the furnace.

As shown in FIG. 3 the furnace 20 is connected to a gas cylinder 60 or other container of material or other flammable gas by a pipe 62 that connects the supply of gas to the manifolds 36, 37, 38 and 39. It is also contemplated that a second cylinder containing oxygen, carbon monoxide or other gas may be provided and connected to the manifolds 36, 37, 38 and 39 by a pipe. (not shown) in order to blend relatively pure oxygen or other gas with the natural gas as for example to raise the temperature in the furnace. It is also contemplated that a mixture of nitrogen and carbon monoxide may be used around the gold while being heated. This is important in view of some of the alloys being used by different dentists. As shown, a plurality of knobs in the front of the furnace 20 are connected to regulate the amount of gases and oxygen fed to the burners 40, 41 and 42. It is also contemplated that the second cylinder or pipe may be used to control the blend of gases in the furnace.

While the invention has been described in connection with its preferred embodiment it should be recognized that changes and modifications may be made therein without departing from the scope of appended claims.

What is claimed is:

1. A portable thermal oven for melting gold and other precious metals, said oven comprising:

a metal frame, means for supporting said frame above the level of a floor and a plurality of insulating terracotta plates disposed in said frame and defining an enclosed chamber having a front panel, a rear panel, two opposite side panels, a top panel, a bottom panel and a lower portion;

a terracotta door having four sides hingedly disposed in said front panel along one side thereof and including a handle on one side thereof for opening and closing said door;

a plurality of gas manifolds and a plurality of gas burners disposed on each of said opposite sides of said chamber and a ventilation hatch in said top panel for exhausting excess heat and fumes from said furnace;

a first gas cylinder containing a supply of flammable gas and a pipe connecting said first gas cylinder to said manifolds;

a supply of air or oxygen and means for feeding said air or oxygen into said furnace;

control means for regulating the flow of gas and the amount of air and/or oxygen from said gas cylinder and said supply of air and oxygen to said manifolds for ignition in said burners;

a support member for receiving a mass of gold or precious metal for melting disposed in said lower portion of said chamber and including a plurality of passageways extending therethrough; and a cone shaped terracotta lined receptacle disposed in said bottom of said chamber and extending through said bottom panel with a larger portion thereof adapted to receive molten metal therein and said bottom portion of said cone-shaped receptacle adapted to direct molten metal into a mold.

2. A portable thermal oven for melting gold and other precious metals according to claim 1 in which said cone shaped receptacle includes an opening and tiltable closure for closing a bottom portion of said receptacle to pour molten metal into a mold or into a casting plate.

3. A portable thermal oven for melting gold and other precious metals according to claim 2 in which said furnace includes a second gas cylinder containing oxygen or other gas and a pipe for connecting said second cylinder to said manifold.

4. A portable thermal oven for melting gold and other precious metals according to claim 3 in which said tiltable closure for opening said cone-shaped receptacle includes a relatively long rod for opening said receptacle from a safe distance removed from molten metal.

5. A portable thermal oven for melting gold and other precious metals according to claim 4 in which said means for supporting said frame above the level of a floor includes four legs having a length at least as long as the height of said chamber and wherein said legs are attached at the corners at the bottom of the frame of said furnace.

6. A portable thermal oven for melting gold and other precious metals according to claim 5 which includes four vertically stacked manifolds on each of said two opposite sides and wherein each of said manifolds include three horizontally aligned gas inlets and a burner at the end of each gas inlet for directing flammable gas into said chamber.

7. A portable thermal oven for melting gold and other precious metals, said oven consisting of:

a metal frame, four legs supporting said frame above the level of a floor and a plurality of terracotta panels disposed in said frame and defining an enclosed chamber having a front panel, a rear panel, two opposite side panels connecting said front and rear panels, a top panel and a bottom panel;

a rectangular terracotta door having four sides hingedly disposed in said front panel and including a handle on one side thereof for opening and closing said door and a glass panel within said door for viewing the interior of said oven;

four vertically spaced gas manifolds disposed on each of said two opposite side panels of said chamber, three gas burners disposed in each of said manifolds and a ventilating shaft disposed in said top panel for exhausting excess heat and fumes from said furnace;

a first gas cylinder including a supply of natural gas and a pipe connecting said gas cylinder to each of said manifolds, a second gas cylinder for supplying air or oxygen or other gas to said chamber and a pipe connecting said second gas cylinder to each of said manifolds;

control means for regulating the flow of flammable gas from said gas cylinder to said manifold and for separately controlling the supply of air, oxygen or other gas from said second cylinder to said manifold for controlling the heat in said oven;

a support plate disposed in a lower portion of said chamber for receiving a mass of gold or precious metal thereon for melting in said oven and said support plate including a plurality of holes extending therethrough;

a cone-shaped terracotta lined receptacle disposed below said support plate and extending through said bottom panel with a larger portion thereof adapted to receive molten metal therein and a closeable opening in a lower portion of said cone-shaped receptacle to deliver molten metal to a mold or casting plate and wherein said closeable opening means includes a relatively long rod for releasing molten metal from said receptacle; and said furnace including two handles attached to an upper portion of said frame for moving said furnace from one location to another.

* * * * *